US009725268B2

(12) United States Patent
Shiina

(10) Patent No.: US 9,725,268 B2
(45) Date of Patent: Aug. 8, 2017

(54) SHEET DETECTING APPARATUS, IMAGE FORMING APPARATUS, AND IMAGE READING APPARATUS

(71) Applicant: CANON KABUSHIKI KAISHA, Tokyo (JP)

(72) Inventor: Sachiyori Shiina, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/327,963

(22) Filed: Jul. 10, 2014

(65) Prior Publication Data

US 2015/0042038 A1 Feb. 12, 2015

(30) Foreign Application Priority Data

Aug. 9, 2013 (JP) ..... 2013-165763

(51) Int. Cl.

*B65H 7/02* (2006.01)
*B65H 7/14* (2006.01)
*B65H 5/06* (2006.01)

(52) U.S. Cl.

CPC ..... *B65H 7/14* (2013.01); *B65H 5/06* (2013.01); *B65H 5/062* (2013.01); *B65H 2403/51* (2013.01); *B65H 2553/412* (2013.01); *B65H 2553/612* (2013.01); *B65H 2553/82* (2013.01)

(58) Field of Classification Search

CPC B65H 7/02; B65H 2511/51; B65H 2511/514; B65H 2407/30; B65H 2511/16; B65H 2511/50; B65H 2513/512; B65H 5/00; B65H 7/00; B65H 7/20; B65H 2553/00; B65H 2553/40; B65H 2553/41; B65H 2553/412; B65H 2511/20; G03G 15/6558; G03G 15/65; G03G 15/2085; G03G 15/2064; G03G 2215/00734; G03G 15/5029

USPC ..... 271/258.01, 265.01; 399/16, 322, 389; 73/865, 8, 865.8

See application file for complete search history.

(56) References Cited

U.S. PATENT DOCUMENTS 5,923,140 A * 7/1999 Azumi et al. ..... 318/640
6,011,948 A 1/2000 Amano et al.
7,992,859 B2 8/2011 Shiina
(Continued)

FOREIGN PATENT DOCUMENTS

EP 0782967 A1 7/1997
EP 0782967 B1 6/2002
(Continued)

OTHER PUBLICATIONS

Machine translation of JP2008-1465.*
Japanese Office Action issued in corresponding Japanese Application No. 2013-165763 dated May 30, 2017.

*Primary Examiner* — Thomas Morrison
(74) *Attorney, Agent, or Firm* — Fitzpatrick, Cella, Harper & Scinto

(57) ABSTRACT

A sheet detecting apparatus which detects a sheet conveyed while being nipped by a pair of fixing rollers includes: an abutting portion which is supported so as to be rotatable about a rotation shaft and against which the sheet abuts; and a photo sensor which detects the rotation of the abutting portion, wherein the rotation shaft is disposed at a predetermined inclination angle so that the rotation shaft is not parallel to a sheet surface of the sheet against which the abutting portion abuts.

13 Claims, 16 Drawing Sheets

(56) References Cited

U.S. PATENT DOCUMENTS

| | | | | |
|---|---|---|---|---|
| 8,528,899 | B2 | 9/2013 | Suzuki | |
| 2008/0141791 | A1* | 6/2008 | Kawasaki et al. | 73/862.381 |
| 2009/0008861 | A1* | 1/2009 | Kasahara | B65H 7/06 271/10.03 |
| 2012/0181741 | A1 | 7/2012 | Suzuki | |
| 2014/0233992 | A1* | 8/2014 | Koyama et al. | 399/322 |

FOREIGN PATENT DOCUMENTS

| | | | |
|---|---|---|---|
| GB | 2299070 | * | 9/1996 |
| JP | 5-306041 | * | 11/1993 |
| JP | 09-183539 | A | 7/1997 |
| JP | 10-7289 | A | 1/1998 |
| JP | 3768578 | B2 | 4/2006 |
| JP | 2008-001465 | A | 1/2008 |
| JP | 2012-144350 | A | 8/2012 |

* cited by examiner

SHEET DETECTING APPARATUS, IMAGE FORMING APPARATUS, AND IMAGE READING APPARATUS

BACKGROUND OF THE INVENTION

Field of the Invention

The present invention relates to a sheet detecting apparatus which detects a conveyed sheet and an image forming apparatus and an image reading apparatus which include the same.

Description of the Related Art

In general, a sheet conveyor of an image forming apparatus is equipped with a sheet conveying apparatus which conveys a sheet to an image forming portion or a discharge tray. The sheet conveying apparatus is equipped with a sensor which detects a sheet in order to control a sheet conveying speed or detect a jam (for example, see U.S. Pat. No. 6,011,948).

A sheet detecting apparatus 620 as a comparative example is illustrated in FIGS. 14 to 15C. As illustrated in FIG. 14, the sheet detecting apparatus 620 of the comparative example is provided at the downstream side in the sheet conveying direction of a pair of conveying rollers 618 and 619 closest to a transfer position where an image formed in an image forming portion is transferred. The sheet detecting apparatus 620 includes an abutting portion 623 which abuts against a sheet S, a photo sensor 624, a light shielding portion 625 which shields an optical path from a light emitting portion to a light receiving portion of the photo sensor 624, and a stopper 626 which positions the abutting portion 623 at a home position.

The abutting portion 623 is provided so as to be rotatable about a rotation shaft 627. The abutting portion 623 is formed so as to return to a home position H illustrated in FIG. 15C by the pressure of a twist coil spring 628. The light shielding portion 625 is integrally formed with the abutting portion 623, and rotates about the rotation shaft 627 along with the abutting portion 623.

As illustrated in FIG. 15A, when a leading end of the sheet S abuts against the abutting portion 623, the abutting portion 623 rotates about the rotation shaft 627 from the home position H illustrated in FIG. 15C in the direction of the arrow a of FIG. 15A, and hence the light shielding portion 625 shields the optical path of the photo sensor 624. When the photo sensor 624 detects a state where the optical path is shielded, the sheet detecting apparatus 620 recognizes a state where the leading end of the sheet S reaches the abutting portion 623.

Subsequently, the sheet S is conveyed while contacting a front end of the abutting portion 623. As illustrated in FIG. 15B, when a tail end of the sheet S passes by the abutting portion 623, the abutting portion 623 rotates in the direction of the arrow b illustrated in FIG. 15C by the biasing force of the twist coil spring 628 so as to return to the home position H. At this time, the light shielding portion 625 is retracted from the optical path of the photo sensor 624, and the light receiving portion of the photo sensor 624 receives the light emitted from the light emitting portion again. Accordingly, the sheet detecting apparatus 620 recognizes a state where the tail end of the sheet S passes by the abutting portion 623.

In recent years, there has been a demand for improving the throughput (the processing capacity per unit time) in the image forming apparatus. There is a case where a gap (hereinafter, referred to as a "sheet gap") from the tail end of the precedent sheet S to the leading end of the subsequent sheet S is shortened in order to improve the throughput in the image forming apparatus. In this case, the sheet detecting apparatus 620 needs to handle the short sheet gap.

The abutting portion 623 of the comparative example rotates while being pressed by the sheet S when the leading end of the sheet S passing through the pair of conveying rollers 618 and 619 abuts against the abutting portion 623. Then, when the tail end of the sheet S is separated from the abutting portion 623, the abutting portion 623 returns to the home position H while being biased by the twist coil spring 628 so that the abutting portion 623 reversely rotates. For that reason, as illustrated in FIG. 15B, the distance necessary as the sheet gap D is the sum of a distance D2 and a mechanical loss amount D1 as a temporal loss amount caused by mechanical operation described in the following Equation 1.

$$D=D1+D2 \quad \text{[Equation 1]}$$

As illustrated in FIG. 15B, the mechanical loss amount D1 is the following distance. That is, the distance corresponds to a distance in which the abutting portion 623 rotates from the position where the tail end of the precedent sheet S passes by the abutting portion 623 about the rotation shaft 627 by the biasing force of the twist coil spring 628 and moves to the home position H illustrated in FIG. 15C.

Meanwhile, the distance D2 is as below. Here, the time until the abutting portion 623 moves by the mechanical loss amount D1 in a manner such that the abutting portion 623 returns to the home position H as illustrated in FIG. 15C after the tail end of the sheet S is separated from the abutting portion 623 as illustrated in FIG. 15B is indicated by Δt. Then, the distance D2 becomes a distance obtained by multiplying the conveying speed V of the sheet S conveyed while being nipped by the pair of conveying rollers 618 and 619 by Δt as illustrated in the following Equation 2.

$$D2=\Delta t \times V \quad \text{[Equation 2]}$$

Then, since Δt is shortened when the mechanical loss amount D1 is shortened, the distance D2 is also shortened depending on the mechanical loss amount D1 from Equation 2. Accordingly, the sheet gap D is shortened depending on the mechanical loss amount D1 from the above-described Equation 1. From the description above, there is a need to shorten the mechanical loss amount D1 in order to shorten the sheet gap D between the precedent sheet S and the subsequent sheet S.

Here, there are proposed techniques in Japanese Patent Laid-Open No. 2008-001465 and U.S. Patent Application Publication No. 2012/181,741 A1. In Japanese Patent Laid-Open No. 2008-001465, a mechanical loss amount may be shortened by inclining a rotation shaft of a sensor flag with respect to a sheet conveying direction h when seen from a direction of a normal line i of a surface of a sheet S. In this way, when the rotation shaft of the sensor flag is obliquely inclined, the falling amount of the sensor in the sheet conveying direction h at the time in which the sensor becomes an ON state due to the passage of the sheet is smaller than that of the comparative example, and hence the mechanical loss amount may be decreased.

Further, in U.S. Patent Application Publication No. 2012/181,741 A1, a sensor flag is not formed in a swing type as in the comparative example, and the sensor flag rotates by one revolution whenever each sheet S passes by the sensor flag. In this way, the mechanical loss amount is decreased.

However, in the configuration of Japanese Patent Laid-Open No. 2008-001465, for example, as illustrated in FIG. 9C, the rotation shaft of the sensor flag is disposed so as to be inclined by 45° as an actual angle with respect to the sheet conveying direction h when seen from the direction of the normal line i of the surface of the sheet S. In that case, the mechanical loss amount is improved only by about 30% compared to the comparative example. Further, in U.S. Patent Application Publication No. 2012/181,741 A1, since almost ten components are used, a space is needed in the sheet conveying direction h.

It is desirable to provide a sheet detecting apparatus having a small mechanical loss amount by simplifying a configuration and saving a space.

SUMMARY OF THE INVENTION

As the representative configuration of a sheet detecting apparatus according to the invention for attaining the above-described object, the sheet detecting apparatus including: a sheet conveyor which conveys a sheet; and a sheet detector which detects the sheet conveyed by the sheet conveyor, wherein the sheet detector includes an abutting portion which is supported so as to be rotatable about a rotation shaft and against which the sheet abuts and a detector which detects the rotation of the abutting portion, and wherein the rotation shaft is disposed so as not to be parallel to a sheet surface of the sheet abutting against the abutting portion.

Further features of the present invention will become apparent from the following description of exemplary embodiments with reference to the attached drawings.

DESCRIPTION OF THE EMBODIMENTS

An embodiment of an image forming apparatus and an image reading apparatus including a sheet detecting apparatus according to the invention will be described in detail with reference to the drawings.

[First Embodiment]

First, the configuration of a first embodiment of an image forming apparatus including a sheet detecting apparatus according to the invention will be described with reference to FIGS. 1 to 9E.

<Entire Configuration of Image Forming Apparatus>

Figure 1:
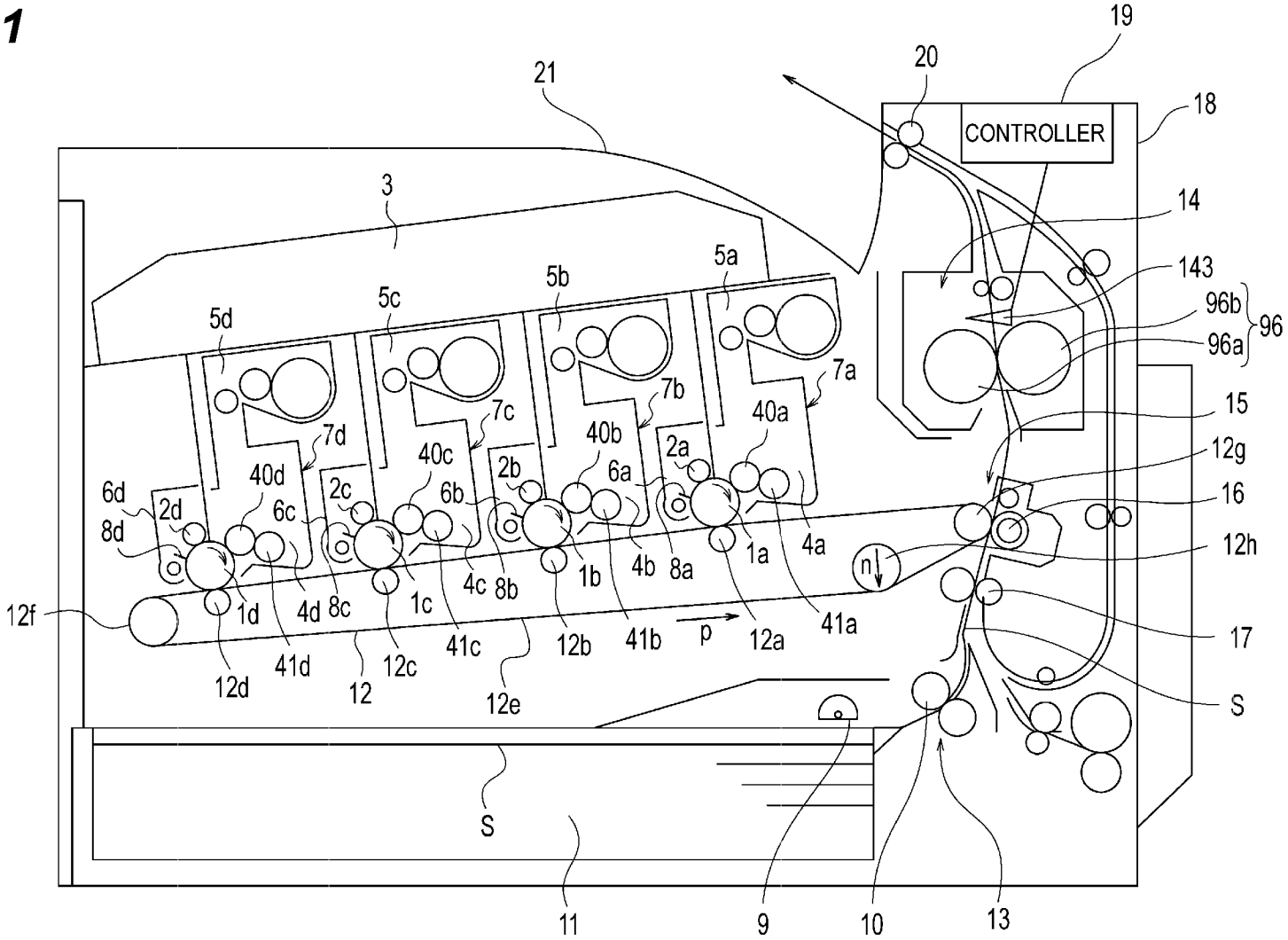
FIG. 1 is a cross-sectional view illustrating the configuration of an image forming apparatus including a sheet detecting apparatus according to the invention.

A color image forming apparatus 18 illustrated in FIG. 1 includes process cartridges 7*a*, 7*b*, 7*c*, and 7*d* as image forming portions which are detachably provided in a main body of the image forming apparatus 18 and form an image on a sheet S. Furthermore, in the description below, the process cartridges 7*a*, 7*b*, 7*c*, and 7*d* will be representatively and simply referred to as the process cartridge 7 for the convenience of description. The same applies to the other image forming process portions.

These four process cartridges 7*a* to 7*d* have the same structure, but are different from one another in that images are formed by toner of different colors of yellow Y, magenta M, cyan C, and black Bk. The process cartridges 7*a* to 7*d* respectively include development units 4*a*, 4*b*, 4*c*, and 4*d* and toner units 5*a*, 5*b*, 5*c*, and 5*d*. The development units 4*a* to 4*d* respectively include photosensitive drums 1*a*, 1*b*, 1*c*, and 1*d* as image bearing members, charging rollers 2*a*, 2*b*, 2*c*, and 2*d*, cleaning blades 8*a*, 8*b*, 8*c*, and 8*d*, and waste toner containers 6*a*, 6*b*, 6*c*, and 6*d*.

Further, the development units 4*a* to 4*d* respectively include development rollers 40*a*, 40*b*, 40*c*, and 40*d* and developer applying rollers 41*a*, 41*b*, 41*c*, and 41*d*. A scanner unit 3 is disposed above the process cartridge 7, and performs an exposure process on each photosensitive drum 1 based on an image signal.

The surface of the photosensitive drum 1 is charged to a predetermined negative potential by the charging roller 2, and is exposed by the scanner unit 3 based on an image signal so that an electrostatic latent image is formed thereon. The electrostatic latent image is reversely developed by the development unit 4, and negative toner is stuck thereto, so that toner images of a yellow Y, a magenta M, a cyan C, and a black Bk are formed.

In an intermediate transfer belt unit 12, an intermediate transfer belt 12*e* is suspended on a drive roller 12*f*, a secondary transfer counter roller 12*g*, and a tension roller 12*h*, and the tension roller 12*h* applies a tension in the direction of the arrow n of FIG. 1. Further, primary transfer rollers 12*a*, 12*b*, 12*c*, and 12*d* are disposed inside the intermediate transfer belt 12*e* so as to respectively face the photosensitive drums 1, and a primary transfer bias voltage is applied thereto by a primary transfer bias power supply (not illustrated).

In the state where the toner images are formed on the surfaces of the photosensitive drums 1, the photosensitive drums 1 are rotated in the clockwise direction of FIG. 1, the intermediate transfer belt 12*e* is rotated in the direction of the arrow p of FIG. 1, and then a positive primary transfer bias voltage is applied to the primary transfer rollers 12*a*, 12*b*, 12*c*, and 12*d*. Accordingly, the toner images are sequentially transferred onto the outer peripheral surface of the intermediate transfer belt 12*e* in order from the toner image on the surface of the photosensitive drum 1*a* as a primary transfer process, and are conveyed to a secondary transfer portion 15 while four colors of the toner images overlap one another.

The sheet conveying apparatus 13 includes a feeding roller 9 which feeds the sheet S from the inside of a sheet cassette 11 accommodating the sheet S and a conveying roller 10 which further conveys the sheet S fed from the feeding roller 9 and fed one by one while being separated by the corporation with a separation portion (not illustrated). Then, the sheet S which is conveyed from the sheet conveying apparatus 13 is conveyed to the secondary transfer portion 15 while being synchronized with the toner image on the outer peripheral surface of the intermediate transfer belt 12*e* by a registration roller 17.

When a positive secondary bias voltage is applied to the secondary transfer roller 16 at the secondary transfer portion 15, for colors of the toner images on the outer peripheral surface of the intermediate transfer belt 12*e* are transferred onto the surface of the sheet S conveyed by the registration roller 17 as a secondary transfer process.

The sheet S onto which the toner image is transferred is conveyed to a fixing device 14, and is heated and pressurized while being conveyed by a fixing roller 96*a* and a pressure roller 96*b* serving as a sheet conveyor for conveying the sheet S, so that the toner image is fixed onto the surface of the sheet S. The sheet S onto which the toner image is fixed is discharged onto a discharge tray 21 by a discharge roller 20.

<Sheet Detecting Apparatus>

As illustrated in FIG. 1, a sheet detecting apparatus 143 is provided at the downstream side (the upside of FIG. 1) of a pair of fixing rollers 96 including the fixing roller 96*a* and the pressure roller 96*b* as the sheet conveyor in the sheet conveying direction. The sheet detecting apparatus 143 is configured as a sheet detector which detects the sheet S that is conveyed while being nipped by the pair of fixing rollers 96.

The sheet detecting apparatus 143 detects the position of the sheet S passing through the pair of fixing rollers 96 provided in the fixing device 14, and transmits the detection information to a controller 19. The controller 19 controls the conveying of the sheet S or notifies a jam (sheet clogging) at the downstream side of the fixing device 14 in the sheet conveying direction based on the detection information transmitted from the sheet detecting apparatus 143.

Figure 2A:
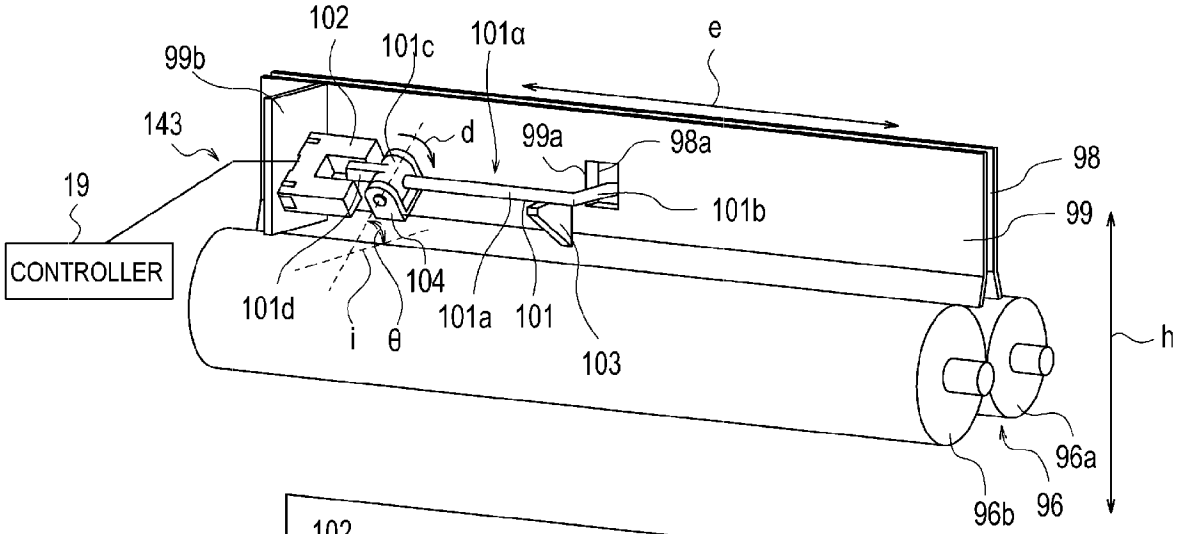
FIG. 2A is a perspective view illustrating the configuration of a sheet detecting apparatus according to a first embodiment of the invention.
Figure 2B:
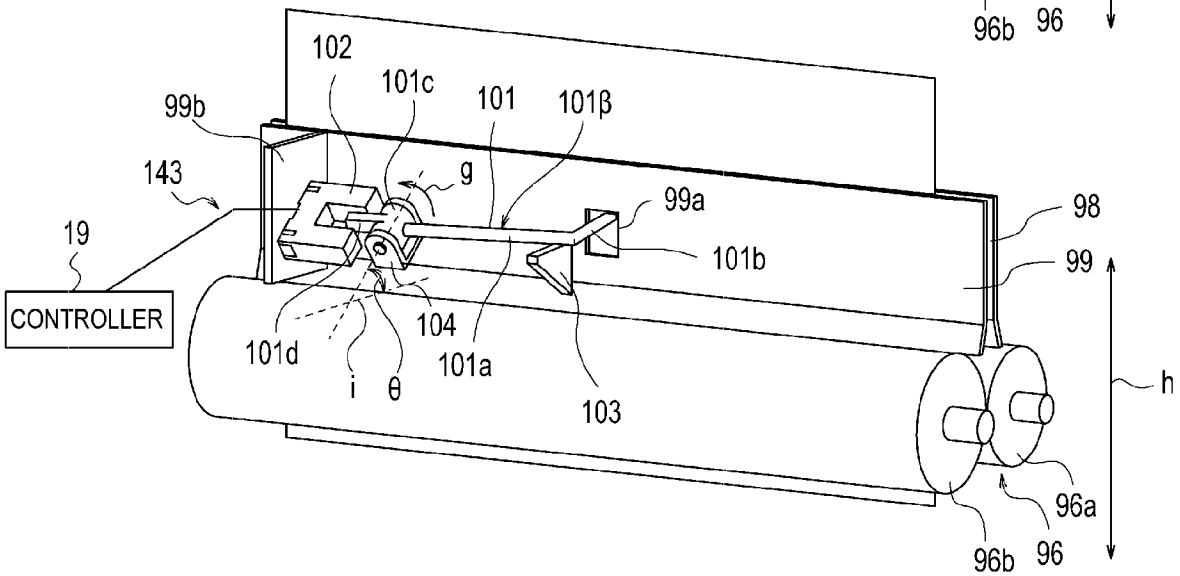
FIG. 2B is a perspective view illustrating the configuration of the sheet detecting apparatus according to the first embodiment of the invention.

FIGS. 2A and 2B are perspective views illustrating the configuration of the sheet detecting apparatus 143 of the embodiment. FIG. 2A illustrates a state where a sensor flag 101 is located at a home position. FIG. 2B illustrates a state where the sheet S abuts against an abutting portion 101*b* of the sensor flag 101 and the sensor flag 101 is rotated about a rotation shaft 101*c* in the direction of the arrow g of FIG. 2B so as to be raised.

The sensor flag 101 is provided at the downstream side (the upside of FIGS. 2A and 2B) of the pair of fixing rollers 96 in the sheet conveying direction. The sheet S is conveyed while being nipped by the pair of fixing rollers 96, and passes between sheet guides 98 and 99.

In the sensor flag 101, an arm portion 101*a* extends in a direction substantially parallel to the axial direction of the pair of fixing rollers 96 (the right and left direction of FIGS. 2A and 2B). The arm portion 101*a* extends from the rotation shaft 101*c* in a direction intersecting the axis line of the rotation shaft 101*c*. Then, the abutting portion 101*b* which is provided at one end of the arm portion 101*a* is bent (curved) in a L-shape from the arm portion 101*a*, is inserted into openings 98*a* and 99*a* penetrating the sheet guides 98 and 99, and contacts the sheet S passing between the sheet guides 98 and 99. The abutting portion 101*b* against which the sheet S abuts is supported so as to be rotatable about the rotation shaft 101*c* provided in a support portion 104 provided in the apparatus frame through the arm portion 101*a*.

The rotation shaft 101*c* is disposed so as to be inclined by a predetermined inclination angle θ with respect to the direction of the normal line i of the sheet surface (the normal direction) so that the rotation shaft is not parallel to the sheet surface of the sheet S against which the abutting portion 101*b* abuts. The direction of the normal line i of the sheet surface is the direction of the normal line i of the sheet conveying path provided in the sheet guides 98 and 99. Further, the rotation shaft 101*c* and the abutting portion 101*b* are disposed so as to be deviated from each other in the sheet width direction (the direction of the arrow e of FIG. 2A) of the sheet S against which the abutting portion 101*b* abuts.

A light shielding portion 101*d* is provided at the end opposite to the abutting portion 101*b* while the rotation shaft 101*c* is located therebetween. Then, a photo sensor 102 as a detector which detects the rotation state of the abutting portion 101*b* while being supported by a support plate 99*b* uprightly formed in the sheet guide 99 is provided at the position corresponding to the light shielding portion 101*d*. The photo sensor 102 includes a light emitting portion and a light receiving portion facing the light emitting portion. Then, as illustrated in FIG. 2A, when the optical path between the light emitting portion and the light receiving portion is interrupted by the light shielding portion 101*d*, the photo sensor 102 becomes an OFF state. Then, as illustrated in FIG. 2B, when the light shielding portion 101*d* is retracted from the optical path between the light emitting portion and the light receiving portion of the photo sensor 102, the photo sensor 102 becomes an ON state.

The light shielding portion 101*d* is provided at the opposite side to the arm portion 101*a* with respect to the rotation shaft 101*c*. Then, when the light shielding portion 101*d* interrupts the optical path between the light emitting portion and the light receiving portion of the photo sensor 102 during the swing of the sensor flag 101, the existence of the sheet S may be detected. Further, a twist coil spring (not illustrated) is fitted to the rotation shaft 101*c* of the sensor flag 101, and the sensor flag 101 is normally biased in the direction of the arrow d of FIG. 2A about the rotation shaft 101*c* due to the biasing force of the twist coil spring.

The apparatus frame is provided with a stopper 103 to which the arm portion 101*a* of the sensor flag 101 is locked in an abutting state. Then, since the arm portion 101*a* of the sensor flag 101 is biased in the direction of the arrow d of FIG. 2A about the rotation shaft 101*c* so as to be locked to the stopper 103 in an abutting state, the sensor flag 101 is set at the home position of FIG. 2A.

Further, the sheet S which is conveyed while being nipped by the pair of fixing rollers 96 is conveyed inside the sheet conveying path provided between the sheet guides 98 and 99. Then, the leading end of the sheet S abuts against the abutting portion 101*b* of the sensor flag 101 protruding into the sheet conveying path so as to press the abutting portion 101*b* upward. Then, the sensor flag 101 rotates about the rotation shaft 101*c* in the direction of arrow g of FIG. 2B.

In the embodiment, the photo sensor 102 is disposed within the roller width of the pair of fixing rollers 96. However, a configuration may be employed in which the light shielding portion 101*d* extends further in the left direction of FIGS. 2A and 2B and the photo sensor 102 is disposed outside the roller width of the pair of fixing rollers 96.

Further, the arm portion 101*a* of the embodiment is provided so as to be substantially parallel to the axial direction of the pair of fixing rollers 96 (the right and left direction of FIGS. 2A and 2B). However, the invention is not limited thereto, and a configuration may be employed in which the arm portion 101*a* is parallel to the sheet conveying surface at one point within the rotation range where the sensor flag 101 rotates about the rotation shaft 101*c*.

Figure 3A:
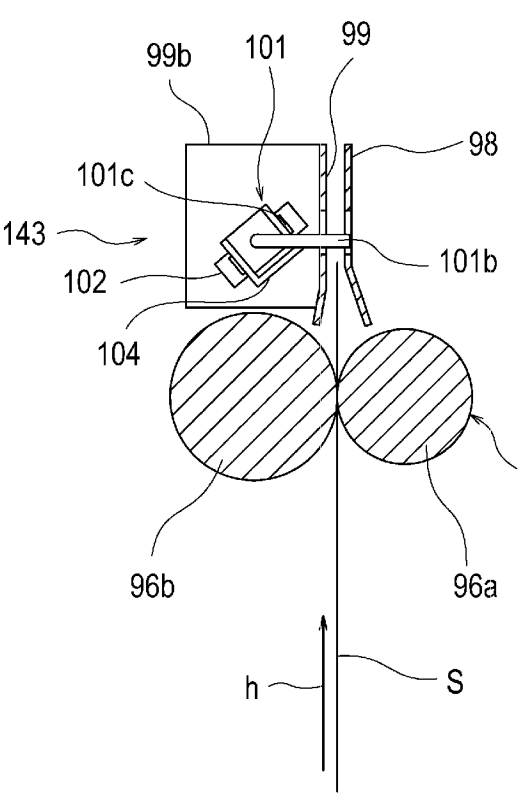
FIG. 3A is a side view in which the sheet detecting apparatus of the first embodiment is seen from the axial direction of a pair of conveying rollers.
Figure 3B:
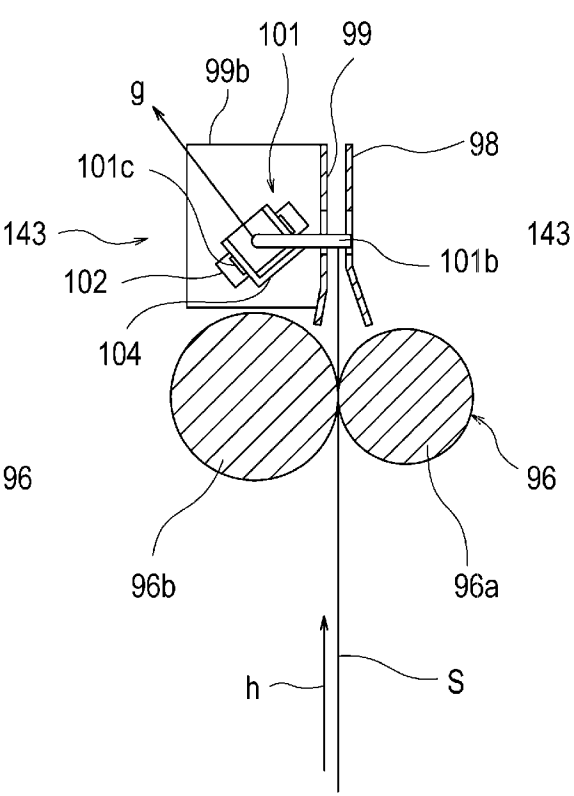
FIG. 3B is a side view in which the sheet detecting apparatus of the first embodiment is seen from the axial direction of the pair of conveying rollers.
Figure 3C:
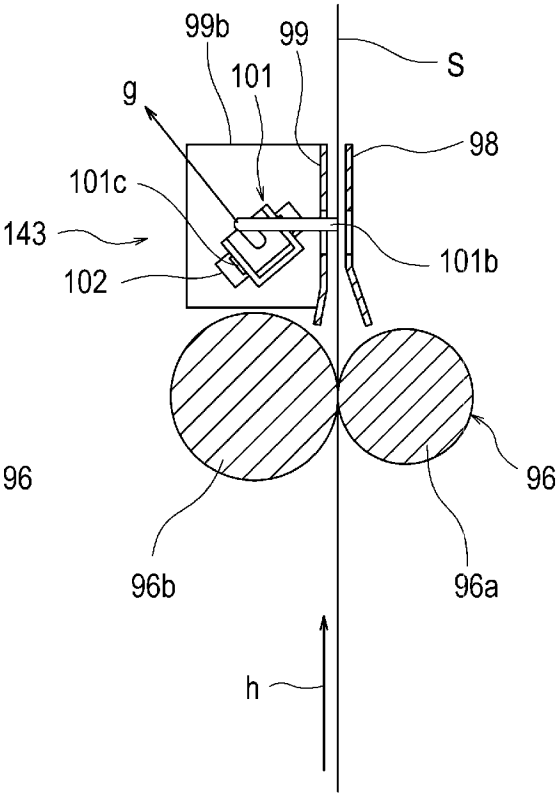
FIG. 3C is a side view in which the sheet detecting apparatus of the first embodiment is seen from the axial direction of the pair of conveying rollers.

With such a configuration, as illustrated in FIGS. 3A to 3C, the area which is necessary for the entire sheet detecting apparatus 143 in the cross-section perpendicular to the axial direction of the pair of fixing rollers 96 may be only an area that forms the operation track of the arm portion 101*a* of the sensor flag 101 and the rotation shaft 101*c*. For this reason, the sheet detecting apparatus 143 may be mounted on the image forming apparatus 18 that decreases in size.

<Operation of Sensor Flag>

Next, the operation of the sensor flag 101 of the embodiment will be described with reference to FIGS. 3A to 3C. FIGS. 3A to 3C are side views in which the sheet detecting apparatus 143 is seen from the direction of the arrow e of FIG. 2A as the axial direction of the pair of fixing rollers 96. FIG. 3A illustrates a state directly before the sheet S rushes into the abutting portion 101*b* of the sensor flag 101.

In FIG. 3B, the sheet S abuts against the abutting portion 101*b* of the sensor flag 101 and the sensor flag 101 is pressed and rotated about the rotation shaft 101*c* in the direction of the arrow g of FIG. 3B. Then, the light shielding portion 101*d* enters the optical path between the light emitting portion and the light receiving portion of the photo sensor 102, and illustrates a state where the sheet S is detected by setting the photo sensor 102 to an OFF state.

In FIG. 3C, the sensor flag 101 rotates about the rotation shaft 101*c* in the direction of the arrow g of FIG. 3B. Accordingly, the abutting portion 101*b* of the sensor flag 101 is retracted in the left direction of FIG. 3C and the sheet S is conveyed in the up direction of FIG. 3C while sliding on the front end of the abutting portion 101*b* of the sensor flag 101.

As illustrated in FIG. 3A, the abutting portion 101*b* of the sensor flag 101 is inserted through the openings 98*a* and 99*a* penetrating the sheet guides 98 and 99. Accordingly, the abutting portion 101*b* of the sensor flag 101 is provided so as to have a predetermined overlap amount with respect to the sheet guide 98. Accordingly, even the sheet S of which the leading end is curled is disposed so as not to slip through the abutting portion 101*b*.

As illustrated in FIG. 3A, the sheet S which is conveyed while being nipped by the pair of fixing rollers 96 is conveyed while being guided by the sheet guides 98 and 99. Then, as illustrated in FIG. 3B, the leading end of the sheet S abuts against the abutting portion 101*b* of the sensor flag 101. When the sheet S is further conveyed while being nipped by the pair of fixing rollers 96, the sensor flag 101 starts to rotate about the rotation shaft 101*c* in the direction of the arrow g of FIG. 3B against the biasing force of the twist coil spring (not illustrated).

When the abutting portion 101*b* of the sensor flag 101 rotates to the position illustrated in FIG. 3B, the light shielding portion 101*d* of the sensor flag 101 shields the optical path between the light emitting portion and the light receiving portion of the photo sensor 102 so that the photo sensor 102 becomes an OFF state. Then, the controller 19 which is provided in the image forming apparatus 18 detects the existence of the sheet S based on the detection result of the photo sensor 102.

As illustrated in FIG. 3C, when the sheet S is further conveyed, the abutting portion 101*b* of the sensor flag 101 continuously rotates about the rotation shaft 101*c* in the direction of the arrow g of FIG. 3C. Then, as illustrated in FIG. 3C, the abutting portion is retracted from the conveying path of the sheet S in the left direction of FIG. 3C. In this state, the abutting portion 101*b* of the sensor flag 101 is retracted from the conveying path of the sheet S, and the sheet S is conveyed while the front end of the abutting portion 101*b* of the sensor flag 101 abuts against the sheet surface of the sheet S. When the tail end of the sheet S comes out, the sensor flag 101 returns to the home position illustrated in FIG. 3A by the biasing force of the twist coil spring (not illustrated).

Furthermore, in the case where the sheet detecting apparatus 143 is used in the image forming apparatus 18 having high durability, the friction generated in the abutting operation may be reduced in a manner such that a roll is provided in the front end of the abutting portion 101*b* of the sensor flag 101 so as to be rotatable in the conveying direction of the sheet S.

Next, the behavior of the sheet S and the abutting portion 101*b* of the sensor flag 101 will be described with reference to FIGS. 4A and 4B. FIG. 4A illustrates a state where the leading end of the sheet S abuts against the abutting portion 101*b* of the sensor flag 101 and presses the sensor flag 101. At this time, the angle formed between the sheet conveying direction h and the longitudinal direction of the abutting portion 101*b* of the sensor flag 101 (the right and left direction of FIG. 4A) is about 90°.

Figure 4B:
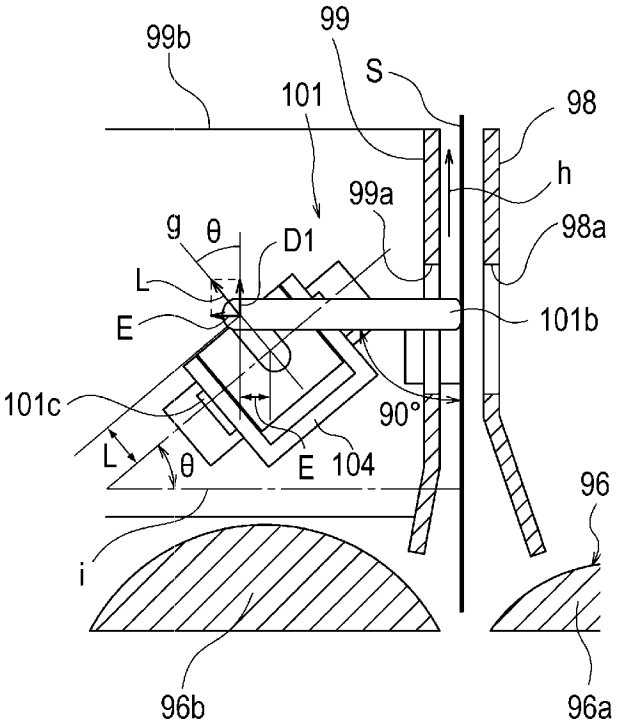
FIG. 4B is a partially enlarged view of FIG. 3C.
Figure 4A:
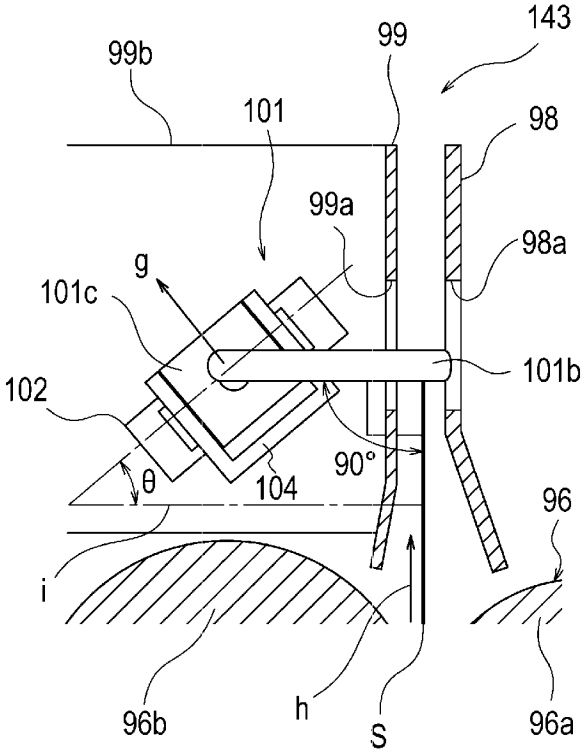
FIG. 4A is a partially enlarged view of FIG. 3B.

When the sheet S is further conveyed from the state illustrated in FIG. 4A, the abutting portion 101*b* of the sensor flag 101 is pressed by the leading end of the sheet S and the sensor flag 101 rotates about the rotation shaft 101*c* in the direction of the arrow g of FIG. 4A so as to move to the position illustrated in FIG. 4B. At that time, the amount in which the sensor flag 101 rotates from the position illustrated in FIG. 4A to the position illustrated in FIG. 4B is indicated by L. Further, the rotation shaft 101*c* of the sensor flag 101 is inclined by an inclination angle θ with respect to the direction of the normal line i of the sheet surface of the sheet S. Then, the mechanical loss amount D1 of the sheet conveying direction h and the retraction amount E in which the abutting portion 101*b* of the sensor flag 101 is retracted in the direction of the normal line i of the sheet surface of the sheet S are expressed by the following Equations 1 and 2.

$$D1 = L \times \cos\theta \quad \text{[Equation 1]}$$

$$E = L \times \sin\theta \quad \text{[Equation 2]}$$

Thus, in the case where the rotation movement amount L of the sensor flag 101 is the same in the above-described Equation 2, sin θ increases as the inclination angle θ (0°<θ<90°) of the rotation shaft 101*c* of the sensor flag 101 with respect to the direction of the normal line i of the sheet surface of the sheet S increases. Then, the retraction amount E in which the abutting portion 101*b* of the sensor flag 101 is retracted in the direction of the normal line i of the sheet surface of the sheet S increases.

Therefore, the inclination angle θ of the rotation shaft 101*c* of the sensor flag 101 with respect to the direction of the normal line i of the sheet surface of the sheet S is set to a large value. In that case, it is possible to ensure the retraction amount E in which the abutting portion is retracted from the conveying path of the sheet S in the left direction of FIG. 4B by the small movement amount of the sheet S in the sheet conveying direction. As a result, the mechanical loss amount D1 may be decreased.

Figure 5B:
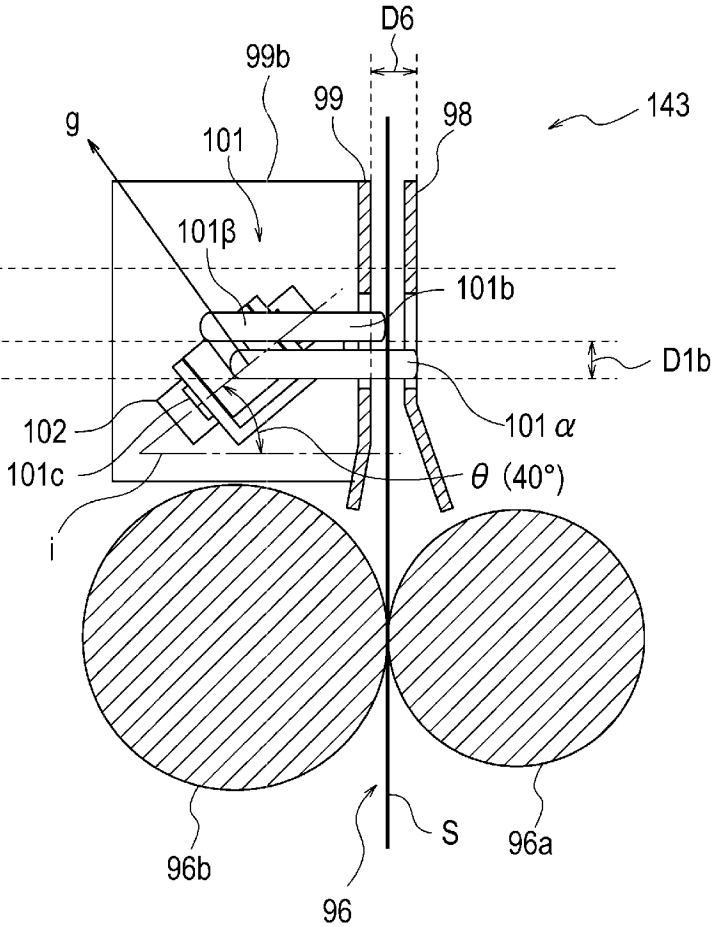
FIG. 5B is a side view in which the sheet detecting apparatus of the first embodiment is seen from the axial direction of the pair of conveying rollers.
Figure 5A:
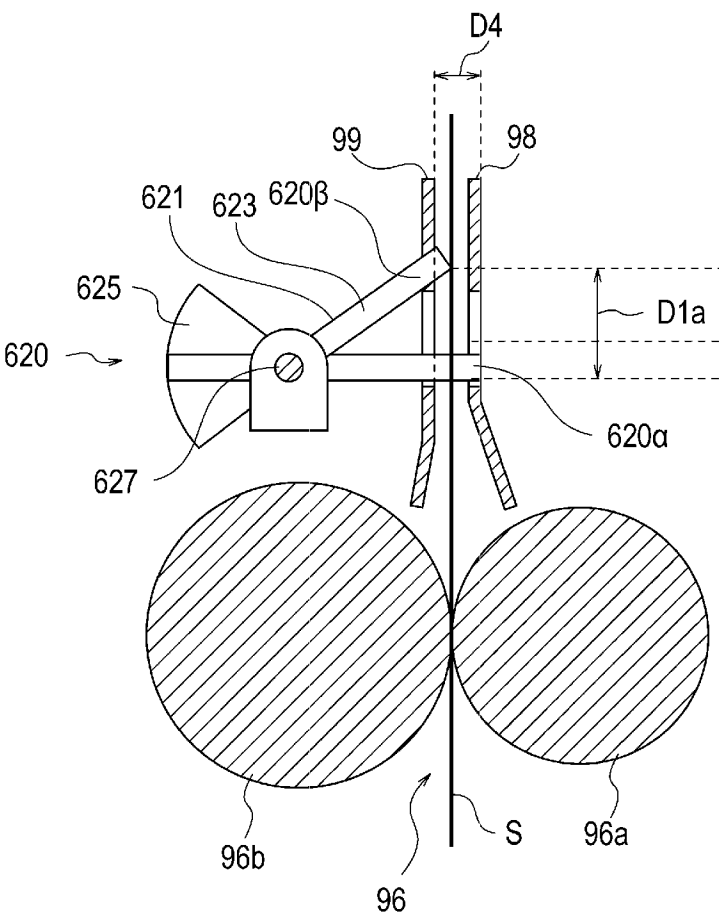
FIG. 5A is a side view in which a sheet detecting apparatus of a comparative example is seen from the axial direction of a pair of conveying rollers.

FIG. 5A illustrates a sensor flag 621 of a comparative example. FIG. 5B illustrates the sensor flag 101 of the embodiment. Then, these drawings illustrate the comparison examples of the ON/OFF timings of the photo sensors 624 and 102 as the timings at which the tail ends of the conveyed sheets S come out in the sensor flags 621 and 101 of FIGS. 5A and 5B.

FIG. 5A illustrates a home position 620α of the sensor flag 621 and a rotation position 620β in which the sensor flag is rotated about a rotation shaft 627 while being pressed by the conveyed sheet S in the comparative example. FIG. 5B illustrates a home position 101α of the sensor flag 101 and a rotation position 101β in which the sensor flag is rotated about the rotation shaft 101*c* while being pressed by the conveyed sheet S in the embodiment.

As illustrated in FIGS. 5A and 5B, the center positions of the rotation shafts 627 and 101*c* of the sensor flags 621 and 101 are set to substantially the same position in order to compare the spaces necessary for installing the sensor flags 621 and 101 when seen from the rotation axis direction of the pair of fixing rollers 96.

Further, the relation between the protrusion amounts D4 and D6 of the abutting portions 623 and 101*b* of the sensor flag 621 of the comparative example and the sensor flag 101 of the embodiment is set as the following Equation 3. The protrusion amounts D4 and D6 of the abutting portions 623 and 101*b* correspond to the protrusion amounts with respect to the sheet conveying path as the distance from the sheet guide 99 to the front ends of the abutting portions 623 and 101*b* at the home position.

$$4 = D6 \quad \text{[Equation 3]}$$

Here, as illustrated in FIG. 5B, the inclination angle θ of the rotation shaft 101*c* of the sensor flag 101 of the embodiment with respect to the direction of the normal line i of the sheet surface is 40°. In that case, the mechanical loss amount D1a of the sensor flag 621 of the comparative example is set to "1". In that case, when the mechanical loss amount D1b of the sensor flag 101 of the embodiment is actually measured, the value becomes "0.28", and hence the mechanical loss amount D1 may be reduced by about 72% (1−0.28=0.72).

On the other hand, the rotation shaft 101*c* of the sensor flag 101 of the embodiment has an inclination angle θ with respect to the direction of the normal line i of the sheet surface. Accordingly, a loss is generated when a force in which the sheet S presses the abutting portion 101*b* of the sensor flag 101 in the sheet conveying direction h is converted into the rotation force about the rotation shaft 101*c* in the direction of the arrow g of FIG. 5B.

Figure 6:
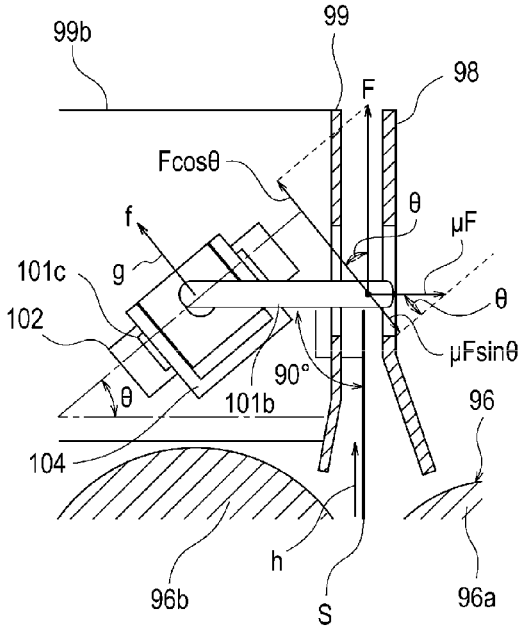
FIG. 6 is a side view in which the sheet detecting apparatus is seen from the axial direction of the pair of conveying rollers in order to describe a force F that is applied from a sheet to an abutting portion and a component force f that directs the abutting portion toward the rotation direction about a rotation shaft in the first embodiment.

As illustrated in FIG. 6, a force in which the leading end of the sheet S abuts against the abutting portion 101*b* of the sensor flag 101 and presses the abutting portion 101*b* is set as F. Further, a force of rotating the sensor flag 101 about the rotation shaft 101*c* in the direction of the arrow g of FIG. 6 is set as f. Further, the friction coefficient between the leading end of the sheet S and the abutting portion 101*b* of the sensor flag 101 is set as μ. Then, when the sliding friction between the rotation shaft 101*c* and the bearing of the support portion 104 rotatably supporting the rotation shaft 101*c* is ignored, the relation of the following Equation 4 is obtained.

$$f=(F\times\cos\theta)-(F\times\mu\times\sin\theta) \quad \text{[Equation 4]}$$

<Optimal Inclination Angle>

In the case where the sensor flag 101 of the embodiment is used, the optimal inclination angle θ of the rotation shaft 101*c* of the sensor flag 101 with respect to the direction of the normal line i of the sheet surface is checked. The left vertical axis of FIG. 7 indicates the mechanical loss amount D1*b* for the inclination angle θ of the rotation shaft 101*c* of the sensor flag 101 of the embodiment with respect to the direction of the normal line i of the sheet surface. Further, the right vertical axis of FIG. 7 indicates the component force G exerted in the direction of the arrow g of FIG. 6 when the abutting portion 101*b* of the sensor flag 101 is pressed by the sheet S and is rotated about the rotation shaft 101*c*.

Figure 7:
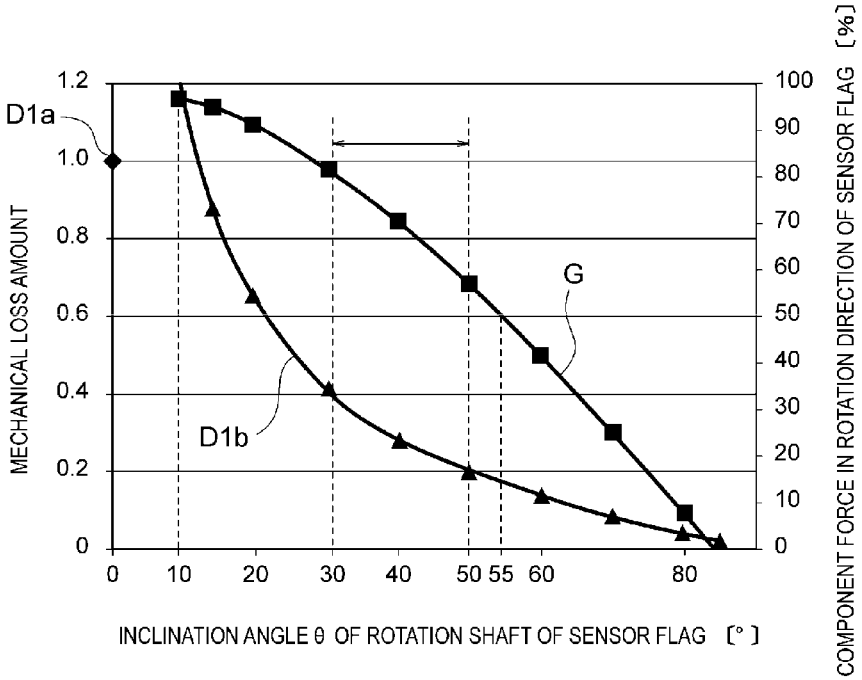
FIG. 7 is a diagram illustrating a relation between a mechanical loss amount for an inclination angle θ of the rotation shaft of the first embodiment with respect to a direction of a normal line i of a sheet surface and the component force f directing the abutting portion toward the rotation direction.

The left vertical axis of FIG. 7 indicates the ratio of the mechanical loss amount D1*b* of the sensor flag 101 of the embodiment illustrated in FIG. 5B when the mechanical loss amount D1*a* of the sensor flag 621 of the comparative example illustrated in FIG. 5A is set as "1". The horizontal axis of FIG. 7 indicates the inclination angle θ of the rotation shaft 101*c* of the sensor flag 101 of the embodiment with respect to the direction of the normal line i of the sheet surface illustrated in FIG. 5B. The right vertical axis of FIG. 7 indicates the ratio of the component force G exerted in the direction of the arrow g of FIG. 6 when the abutting portion 101*b* of the sensor flag 101 is pressed by the sheet S and is rotated about the rotation shaft 101*c*.

When the abutting portion 101*b* of the sensor flag 101 is pressed by the sheet S and is rotated about the rotation shaft 101*c*, there is a case in which the value of the component force G exerted in the direction of the arrow g of FIG. 6 is large. In that case, the loss of the force generated when the sheet S passes by the abutting portion 101*b* of the sensor flag 101 becomes small, and the reaction force transmitted from the abutting portion 101*b* becomes small. Further, when the value of the component force G is small, the sheet S receives a large reaction force from the abutting portion 101*b*. As a result, there is a high possibility that the sensor flag 101 may not be operated properly or the leading end of the sheet S may be scratched.

As illustrated in FIG. 7, the inclination angle θ of the rotation shaft 101*c* of the sensor flag 101 of the embodiment with respect to the direction of the normal line i of the sheet surface increases. Then, when the abutting portion 101*b* of the sensor flag 101 is pressed by the sheet S and is rotated about the rotation shaft 101*c*, the component force G exerted in the direction of the arrow g of FIG. 6 decreases. On the other hand, there is a tendency that the mechanical loss amount D1*b* indicated by the left vertical axis of FIG. 7 decreases as the inclination angle θ increases.

As illustrated in FIG. 7, the curve of the mechanical loss amount D1*b* has a downward convex shape. In particular, the inclination angle θ of the rotation shaft 101*c* of the sensor flag 101 of the embodiment with respect to the direction of the normal line i of the sheet surface is in the angle range of 10° to 30°. In the angle range, the mechanical loss amount D1*b* abruptly decreases as the inclination angle θ increases.

The mechanical loss amount D1*a* of the sensor flag 621 of the comparative example illustrated in FIG. 5A is fixed to "1.0" on the left vertical axis of FIG. 7 when the inclination angle θ of the rotation shaft 627 with respect to the direction of the normal line i of the sheet surface is 0° as illustrated in the horizontal axis of FIG. 7. For this reason, there is a merit that the mechanical loss amount D1*b* decreases when the inclination angle θ of the rotation shaft 101*c* of the sensor flag 101 of the embodiment with respect to the direction of the normal line i of the sheet surface becomes 20° compared to the mechanical loss amount D1*a* of the sensor flag 621 of the comparative example illustrated in FIG. 5A.

Further, the abutting portion 101*b* of the sensor flag 101 is pressed by the sheet S and is rotated about the rotation shaft 101*c*. At that time, the curve of the component force G exerted in the direction of the arrow g of FIG. 6 decreases in a substantially inversely proportional state as the inclination angle θ of the rotation shaft 101*c* of the sensor flag 101 with respect to the direction of the normal line i of the sheet surface increases. Then, the component force G is smaller than 50% at the angle range in which the inclination angle θ is about 55° or more.

From the description above, the sensor flag 101 of the embodiment may be most effectively used as below. That is, it is desirable to set the inclination angle θ of the rotation shaft 101*c* of the sensor flag 101 with respect to the direction of the normal line i of the sheet surface in the angle range of 30° to 50° in which the difference between the component force G and the mechanical loss amount D1*b* illustrated in FIG. 7 is largest. Furthermore, in the graph of the component force G and the mechanical loss amount D1*b* illustrated in FIG. 7, the friction coefficient μ of the leading end of the sheet S and the abutting portion 101*b* of the sensor flag 101 is set as 0.1 for the calculation.

<Sheet Position Detection Error>

Figure 8B:
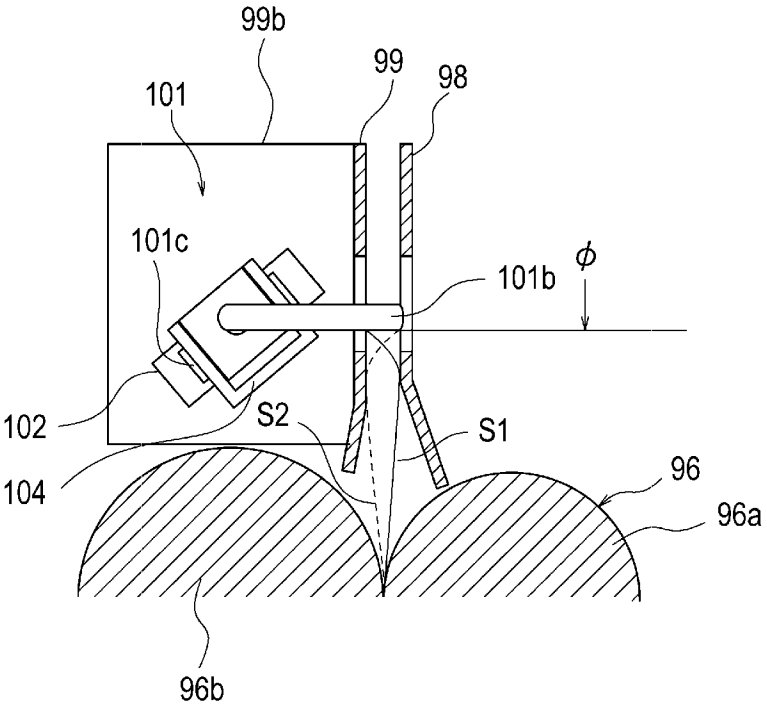
FIG. 8B is a side view in which the sheet detecting apparatus of the first embodiment illustrating a state where an error does not occur in the leading end detection position regardless of the curl direction of the sheet is seen from the axial direction of the pair of conveying rollers in the first embodiment.
Figure 8A:
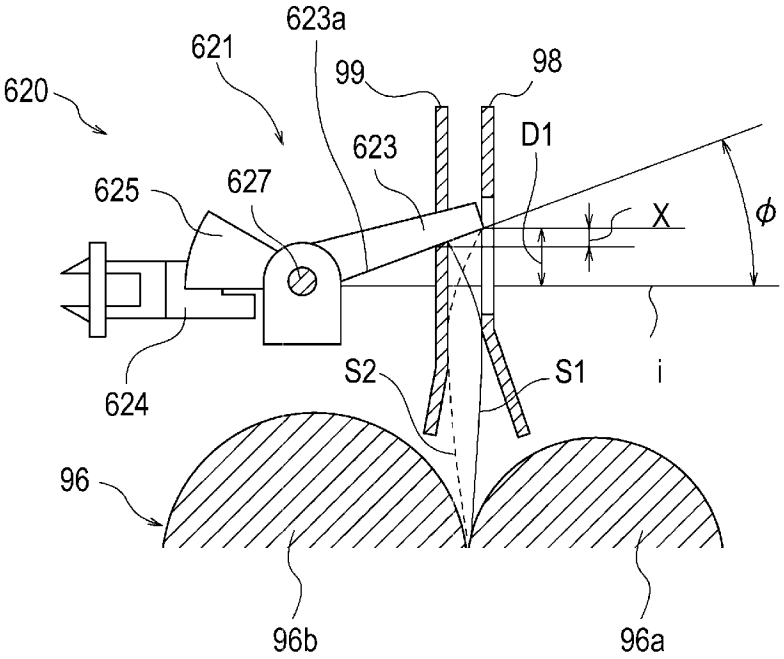
FIG. 8A is a side view in which the sheet detecting apparatus of the comparative example illustrating a state where an error occurs in a leading end detection position due to the curl direction of the sheet is seen from the axial direction of the pair of conveying rollers in the comparative example.

Next, the sheet position detection error will be described with reference to FIGS. 8A and 8B. FIG. 8A is a side view illustrating a state where the sensor flag 621 of the comparative example detects the sheet S, and FIG. 8B is a side view illustrating a state where the sensor flag 101 of the embodiment detects the sheet S. As illustrated in FIG. 8A, in the sensor flag 621 of the comparative example, in many cases, an abutting surface 623*a* with respect to the sheet S has an inclination angle ϕ with respect to the direction of the normal line i of the sheet surface of the sheet S while the sheet S is detected as described above.

For this reason, the sheet S1 which is curled in a convex shape toward the sheet guide 98 as indicated by the solid line of FIG. 8A and the sheet S2 which is curled in a convex shape toward the sheet guide 99 as indicated by the dashed line of FIG. 8A have the following characteristic. That is, there is a possibility that the leading end detection position of the sheet S may have an error of a distance X in the sheet conveying direction h.

Meanwhile, as illustrated in FIG. 8B, the abutting portion 101*b* of the sensor flag 101 of the embodiment detects the existence of the sheet S when the inclination angle ϕ with respect to the direction of the normal line i of the sheet surface is 0°. For that reason, there is a case where the sheet S1 which is curled in a convex shape toward the sheet guide 98 as indicated by the solid line of FIG. 8B or the sheet S2 which is curled in a convex shape toward the sheet guide 99 as indicated by the dashed line of FIG. 8B may be conveyed. Even in that case, the existence of the sheet S is detected at the constant position in the sheet conveying direction h. Accordingly, the position detection error substantially does not occur due to the curled sheet S, and hence the sheet position may be detected with high precision.

<Inclination Direction of Rotation Shaft>

Next, the inclination direction of the rotation shaft 101*c* of the sensor flag 101 of the embodiment will be described with reference to FIGS. 9A to 9E. The left drawings of FIGS. 9B to 9E illustrates the projection line obtained when the rotation shaft 101*c* of the sensor flag 101 is seen from the direction of the normal line i of the sheet surface illustrated in FIG. 9A. The right drawings of FIGS. 9B to 9E indicate the projection line obtained when the rotation shaft 101*c* of the sensor flag 101 is seen from the direction of the arrow e as the axial direction of the pair of fixing rollers 96 illustrated in FIG. 9A.

Figure 9A:
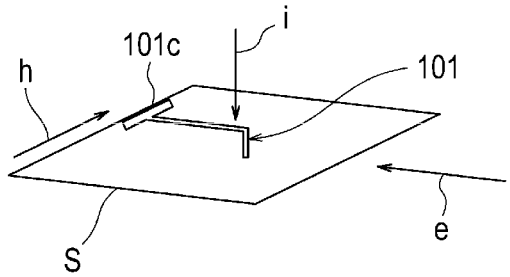
FIG. 9A is a view illustrating the projection direction of the rotation shaft.
Figure 9B:
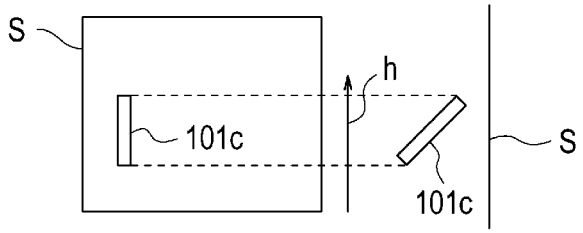
FIG. 9B is a view illustrating a state where various rotation shafts are projected from the direction of the normal line i of the sheet surface at the left side and illustrating a state where various rotation shafts are projected from the axial direction of the pair of conveying rollers at the right side.

In the embodiment illustrated in FIG. 9B, the rotation shaft 101*c* of the sensor flag 101 is parallel to the sheet conveying direction h when seen from the direction of the normal line i of the sheet surface. Then, the rotation shaft 101*c* which is seen from the direction of the arrow e as the axial direction of the pair of fixing rollers 96 is inclined with respect to the sheet conveying direction h.

Figure 9C:
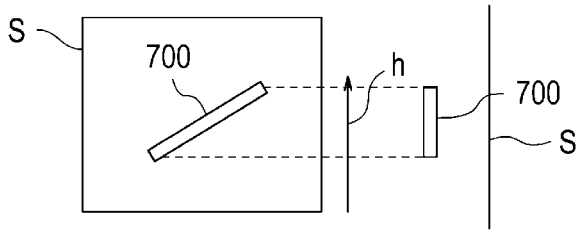
FIG. 9C is a view illustrating a state where various rotation shafts are projected from the direction of the normal line i of the sheet surface at the left side and illustrating a state where various rotation shafts are projected from the axial direction of the pair of conveying rollers at the right side.

As illustrated in FIG. 9C, this configuration is different from the configuration of Japanese Patent Laid-Open No. 2008-001465 in which a rotation shaft 700 of a sensor flag is disposed in an inclined state. The direction of the rotation shaft 700 of Japanese Patent Laid-Open No. 2008-001465 is inclined with respect to the sheet conveying direction h when seen from the direction of the normal line i of the sheet surface. Then, the rotation shaft 700 when seen from the direction of the arrow e as the axial direction of the pair of conveying rollers is parallel to the sheet conveying direction h. Thus, the inclined plane direction is different from that of the rotation shaft 101*c* of the embodiment illustrated in FIG. 9B.

Figure 9D:
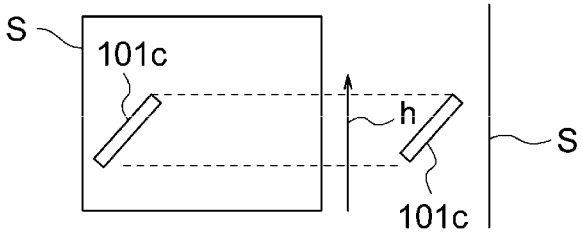
FIG. 9D is a view illustrating a state where various rotation shafts are projected from the direction of the normal line i of the sheet surface at the left side and illustrating a state where various rotation shafts are projected from the axial direction of the pair of conveying rollers at the right side.
Figure 9E:
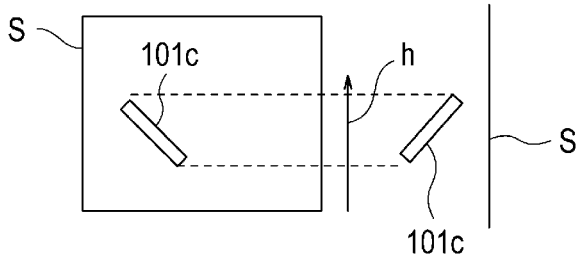
FIG. 9E is a view illustrating a state where various rotation shafts are projected from the direction of the normal line i of the sheet surface at the left side and illustrating a state where various rotation shafts are projected from the axial direction of the pair of conveying rollers at the right side.

Furthermore, the inclination direction of the rotation shaft 101*c* of the sensor flag 101 does not need to be limited to the inclination direction illustrated in FIG. 9B. That is, as illustrated in FIGS. 9D and 9E, the inclination direction of the rotation shaft 101*c* is inclined with respect to the sheet conveying direction h when seen from the direction of the normal line i of the sheet surface. Further, the rotation shaft may be inclined with respect to the sheet conveying direction h when seen from the direction of the arrow e as the axial direction of the pair of fixing rollers 96. That is, when the rotation shaft 101*c* of the sensor flag 101 of the embodiment is widely understood, the rotation shaft 101*c* is inclined in a direction which is not parallel to the direction of the normal line i of the sheet surface.

According to the above-described configuration, it is possible to obtain a simple configuration just including the sensor flag 101 and the photo sensor 102 without adding particular components. Further, the arm portion 101*a* of the sensor flag 101 extends in the axial direction of the pair of fixing rollers 96. For this reason, a large space is not necessary for the rotation of the sensor flag 101 in the cross-section direction perpendicular to the axial direction of the pair of fixing rollers 96. Accordingly, it is possible to save a space.

Further, the mechanical loss amount D1*b* and the sheet position detection error may be largely decreased. Accordingly, even in the image forming apparatus 18 which decreases in cost and size, it is possible to realize the image forming apparatus 18 in which the sheet gap D between the precedent sheet S and the subsequent sheet S is small.

[Second Embodiment]

Next, the configuration of a sheet detecting apparatus according to a second embodiment of the invention and an image forming apparatus including the same will be described with reference to FIGS. 10 to 13B. Furthermore, the same component as that of the first embodiment will be described by using the same reference numeral or the same name even when the reference numeral is different.

Figure 10:
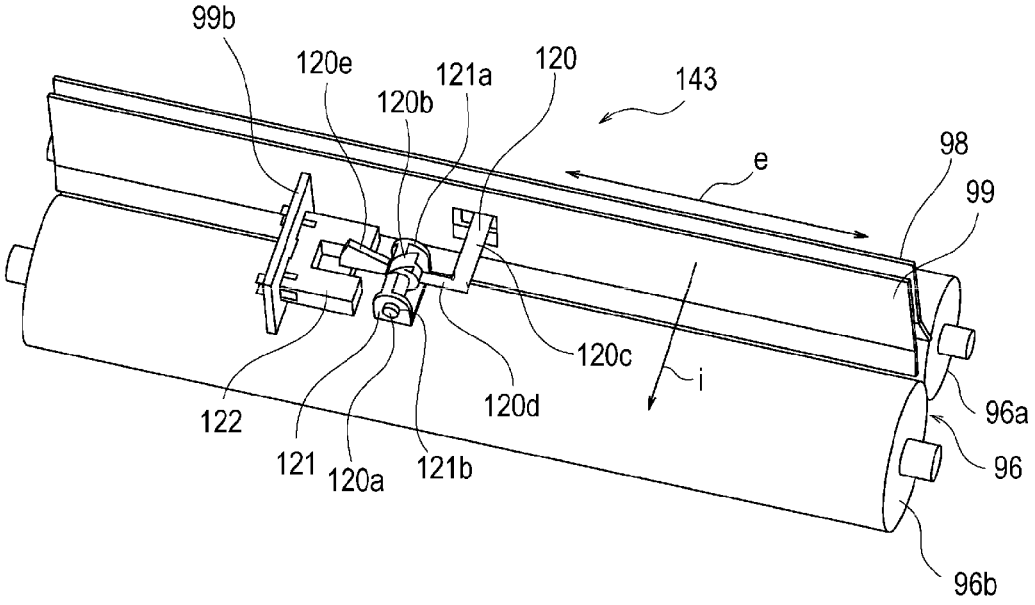
FIG. 10 is a perspective view illustrating the configuration of a sheet detecting apparatus according to a second embodiment of the invention.
Figure 11:
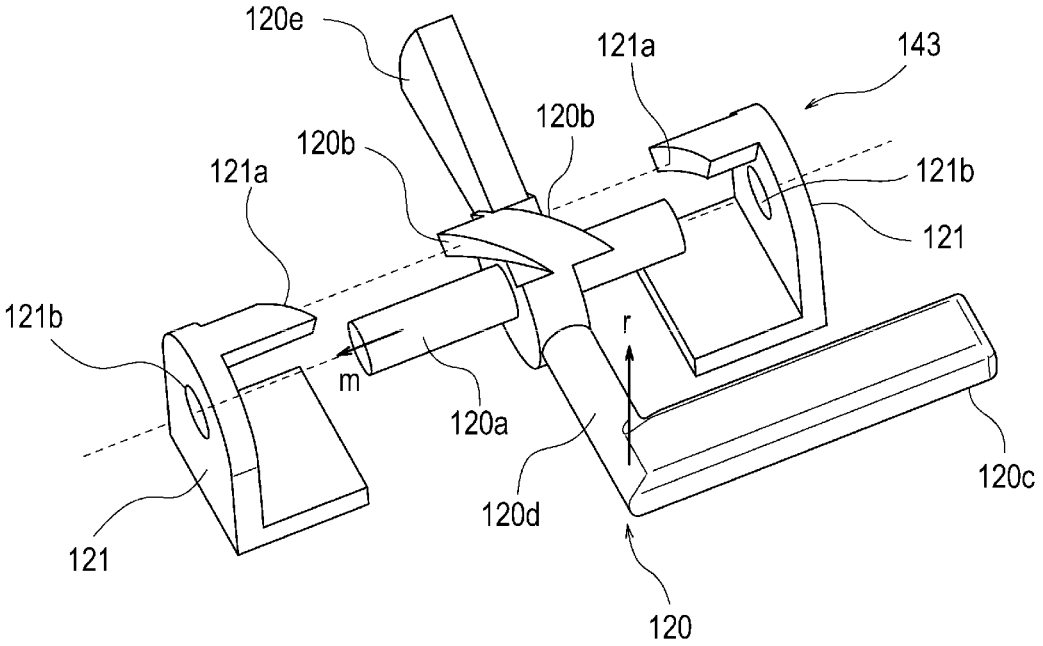
FIG. 11 is an exploded perspective view illustrating a state where a rotation shaft slides in the axial direction due to the action of a cam shape formed in a peripheral wall surface of the rotation shaft provided in the sheet detecting apparatus of the second embodiment.

FIGS. 10 to 13B are views illustrating the configuration of the sheet detecting apparatus 143 of the embodiment. FIG. 10 is a perspective view illustrating a state where the sheet detecting apparatus 143 of the embodiment is disposed in the image forming apparatus 18. FIG. 11 is an exploded perspective view illustrating the configuration of respective portions of the sensor flag 120 and a support member 121 of the embodiment.

As illustrated in FIG. 10, the sensor flag 120 of the embodiment includes an abutting portion 120*c* which is supported so as to be rotatable about a rotation shaft 120*a* and against which the sheet S abuts as in the sensor flag 101 of the first embodiment. Further, the sensor flag 120 includes an arm portion 120*d* and a photo sensor 122 which serves as a detector for detecting the rotation state of the abutting portion 120*c*. When the optical path between the light emitting portion and the light receiving portion of the photo sensor 122 is shielded by a light shielding portion 120*e* rotating about the rotation shaft 120*a* along with the arm portion 120*d*, the photo sensor 122 becomes an ON/OFF state, and hence the existence of the sheet S is detected.

Even in the embodiment, the rotation shaft 120*a* and the abutting portion 120*c* are disposed so as to be deviated from each other in the sheet width direction (the right and left direction of FIG. 10) of the sheet S abutting against the abutting portion 120*c*.

As illustrated in FIG. 11, the rotation shaft 120*a* is inserted through a penetration hole 121*b* as a bearing provided in the support member 121 in a rotatable state, so that the sensor flag 120 is supported so as to be rotatable about the rotation shaft 120*a*. The direction of the rotation shaft 120*a* is parallel to the direction of the normal line i of the sheet surface. The peripheral wall surface of the rotation shaft 120*a* is provided with a spiral cam 120*b* which is formed in a cam shape in which the abutting portion 120*c* slides in the axial direction of the rotation shaft 120*a* in response to the rotation of the abutting portion 120*c*. The spiral cam 120*b* which is provided in the peripheral wall surface of the rotation shaft 120*a* slides while abutting against a spiral cam 121*a* provided in the inner peripheral surface of the support member 121, so that the abutting portion 120*c* slides in the axial direction of the rotation shaft 120*a*.

Furthermore, an embodiment has been exemplified in which the spiral cams are provided in both the rotation shaft 120*a* and the support member 121 as the cam portions that move the sensor flag 120 in the axial direction in response to the rotation of the sensor flag 120. However, a cam shape may be employed in which the cam portion that moves the sensor flag 120 in the axial direction in response to the rotation of the sensor flag 120 is provided in one of the rotation shaft 120*a* and the support member 121.

<Operation of Spiral Cam and Sensor Flag>

Next, the operations of the spiral cams 120*b* and 121*a* and the sensor flag 120 will be described with reference to FIG. 11. As illustrated in FIG. 11, the spiral cam 120*b* is provided in the upper portion of the peripheral wall surface of the rotation shaft 120*a*. The spiral cam 121*a* which slides while abutting against the spiral cam 120*b* is provided at a position facing the spiral cam 120*b* in the support member 121. When the sensor flag 120 rotates about the rotation shaft 120*a* in the direction of the arrow r of FIG. 11, the sensor flag 120 moves in the direction of the arrow m of FIG. 11 while being guided to the spiral cam 120*b* sliding while abutting against the spiral cam 121*a* of the support member 121.

The arm portion 120*d* may sufficiently ensure the retraction amount E in the direction of the normal line i of the sheet surface by the cam operations of the spiral cam 121*a* of the support member 121 and the spiral cam 120*b* of the rotation shaft 120*a* even at a small raised angle. For this reason, the length of the arm portion 120*d* is set to be shorter than the length of the arm portion 101*a* of the sensor flag 101 of the first embodiment.

Figure 12:
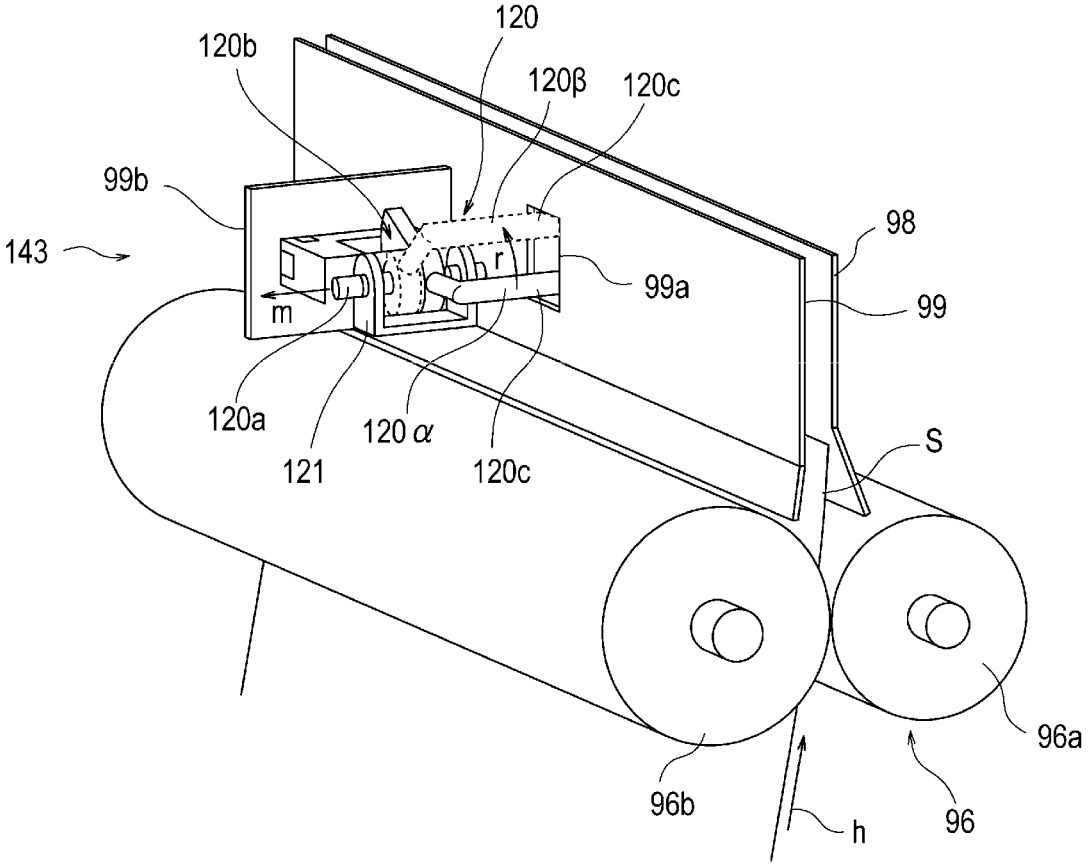
FIG. 12 is a perspective view illustrating a state where an abutting portion slides in the axial direction of the rotation shaft in response to the rotation of the abutting portion due to the action of the cam shape formed in the peripheral wall surface of the rotation shaft in the sheet detecting apparatus of the second embodiment.

FIG. 12 is a perspective view in which the operation track of the sensor flag 120 is indicated by the solid line (a home position 120α) and the dashed line (a rotation position 120β). The sensor flag 120 which is indicated by the solid line of FIG. 12 indicates the home position 120α, and the sensor flag 120 which is indicated by the dashed line of FIG. 12 indicates the rotation position 120β where the abutting portion 120*c* is pressed by the sheet S and is rotated about the rotation shaft 120*a*.

The leading end of the sheet S which is conveyed while being nipped by the pair of fixing rollers 96 as the sheet conveyor for conveying the sheet S abuts against the abutting portion 120*c* of the sensor flag 120. Then, the sensor flag 120 which is retained at the home position 120α indicated by the solid line of FIG. 12 rotates in the direction of the arrow r of FIG. 12 by the force of conveying the sheet S.

At that time, the spiral cam 120*b* which is provided in the peripheral wall surface of the rotation shaft 120*a* illustrated in FIG. 11 slides while abutting against the spiral cam 121*a* provided in the support member 121. Then, the sensor flag 120 is guided by the spiral cam 120*b* so that the sensor flag slides in the direction of the arrow m of FIG. 12 while rotating about the rotation shaft 120*a* in the direction of the arrow r of FIG. 12, and moves to the rotation position 120β indicated by the dashed line of FIG. 12.

There is a case where the sheet S passes while sliding on and abutting against the abutting portion 120*c* of the sensor flag 120. In the meantime, the sensor flag 120 is retained at the rotation position 120β indicated by the dashed line of FIG. 12. Further, the tail end of the sheet S passes by the abutting portion 120*c* of the sensor flag 120. Then, the sensor flag 120 rotates about the rotation shaft 120*a* in a direction opposite to the direction of the arrow r of FIG. 12 by the biasing force of the twist coil spring (not illustrated). Further, the sensor flag 120 slides in a direction opposite to the direction of the arrow m of FIG. 12 due to the sliding movement of the spiral cams 120*b* and 121*a* in an abutting state. Then, the sensor flag 120 returns to the home position 120α indicated by the solid line of FIG. 12.

The leading end of the sheet S abuts against the abutting portion 120*c* of the sensor flag 120, and the sensor flag 120 rotates about the rotation shaft 120*a* in the direction of the arrow r of FIG. 12. At that time, the spiral cams 120*b* and 121*a* slide while abutting against each other. Accordingly, the abutting portion 120*c* of the sensor flag 120 is retracted in the direction of the arrow m of FIG. 12 parallel to the direction of the normal line i of the sheet surface of the sheet S. The retraction amount with respect to the rotation angle of the sensor flag 120 may be appropriately set by the spiral shapes of the spiral cams 120*b* and 121*a*.

<Arrangement Direction of Rotation Shaft>

Figure 13A:
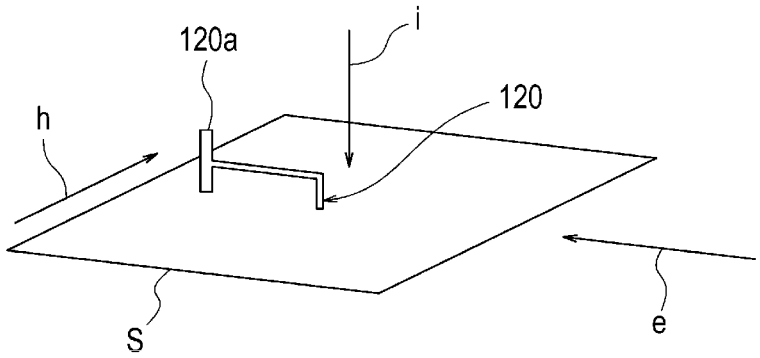
FIG. 13A is a view illustrating the projection direction of the rotation shaft.

Next, the arrangement direction of the rotation shaft 120*a* of the sensor flag 120 of the embodiment will be described with reference to FIGS. 13A and 13B. The left drawing of FIG. 13B indicates the projection line obtained when the rotation shaft 120*a* of the sensor flag 120 is seen from the direction of the normal line i of the sheet surface illustrated in FIG. 13A. The right drawing of FIG. 13B indicates the projection line obtained when the rotation shaft 120*a* of the sensor flag 120 is seen from the direction of the arrow e as the axial direction of the pair of fixing rollers 96 illustrated in FIG. 13A.

Figure 13B:
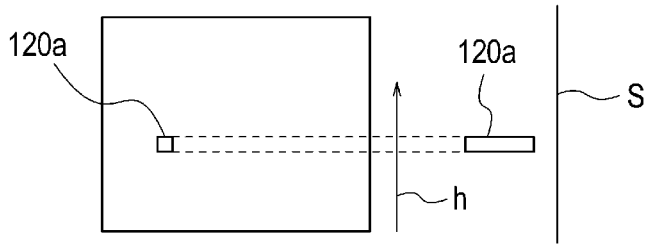
FIG. 13B is a view illustrating a state where the rotation shaft is projected in a direction of a normal line i of a sheet surface at the left side of the sheet detecting apparatus of the second embodiment and a state where the rotation shaft is projected in the axial direction of a pair of conveying rollers at the right side thereof.
Figure 14:
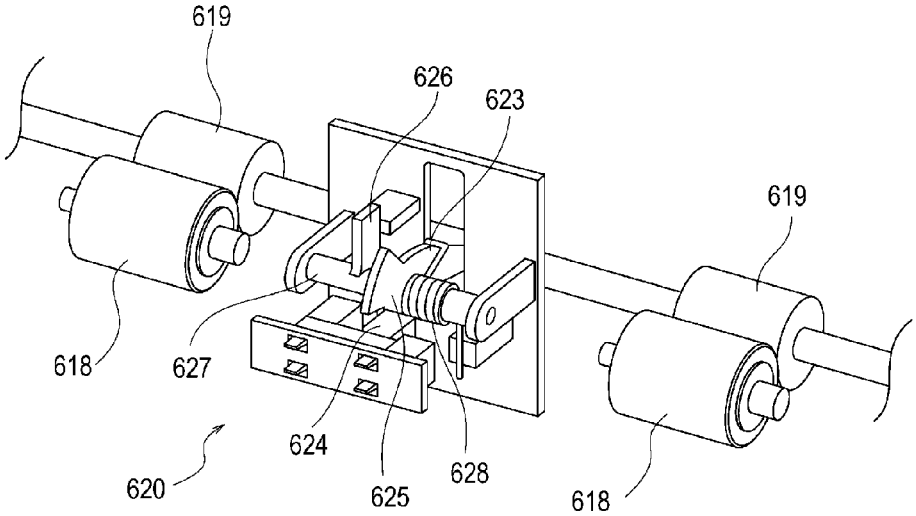
FIG. 14 is a perspective view illustrating the configuration of a sheet detecting apparatus of a comparative example.
Figure 15A:
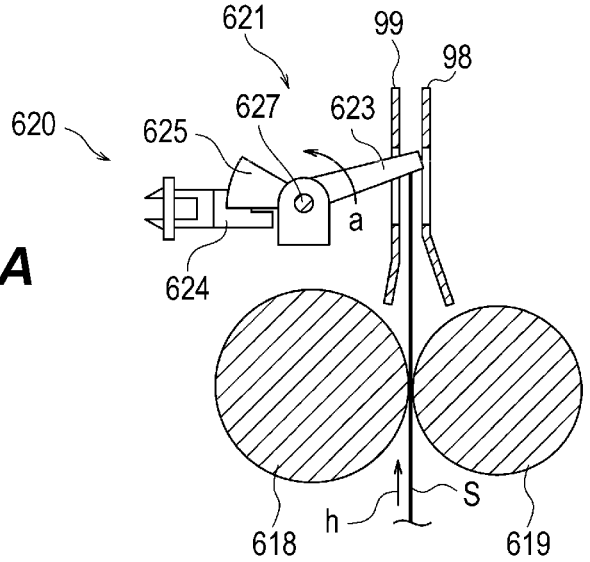
FIG. 15A is a side view in which the sheet detecting apparatus of the comparative example is seen from the axial direction of a pair of conveying rollers.
Figure 15B:
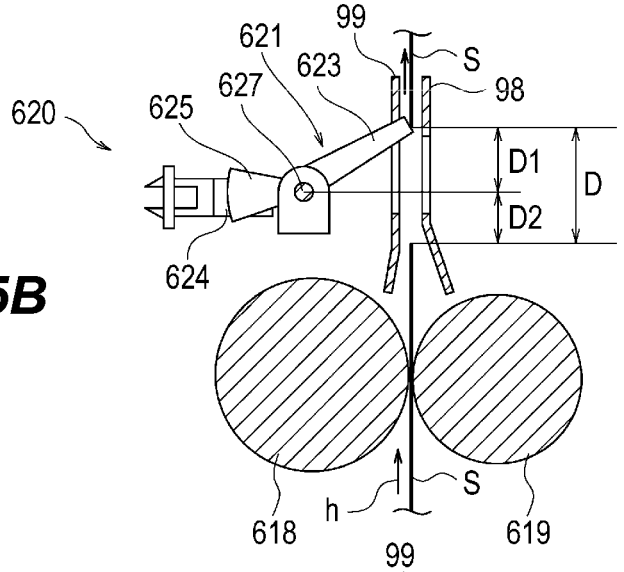
FIG. 15B is a side view in which the sheet detecting apparatus of the comparative example is seen from the axial direction of the pair of conveying rollers.
Figure 15C:
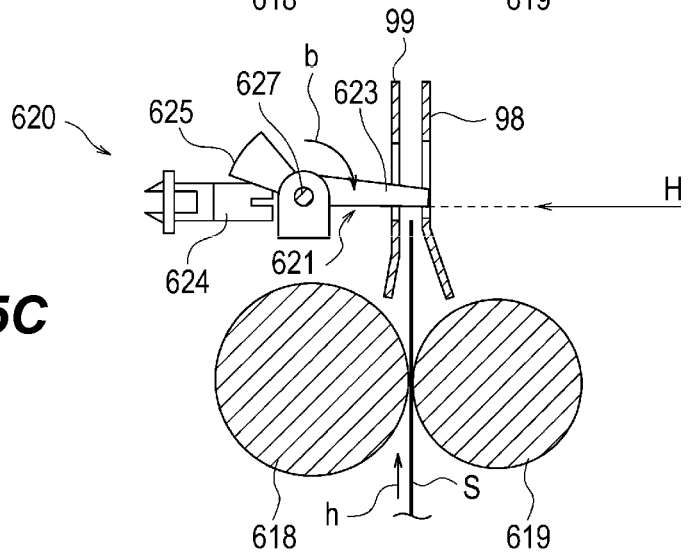
FIG. 15C is a side view in which the sheet detecting apparatus of the comparative example is seen from the axial direction of the pair of conveying rollers.

In the embodiment illustrated in FIG. 13B, the rotation shaft 120*a* of the sensor flag 120 is parallel to the direction of the normal line i when seen from the direction of the normal line i of the sheet surface, and the rotation shaft 120*a* becomes a point as illustrated in FIG. 13B when the rotation shaft 120*a* is projected from the direction of the normal line of the sheet surface. Further, the rotation shaft 120*a* is disposed so as to be perpendicular to the sheet conveying direction h.

Further, the rotation shaft 120*a* which is seen from the direction of the arrow e as the axial direction of the pair of fixing rollers 96 is provided so as to be perpendicular to the sheet conveying direction h. Thus, when even the embodiment is widely understood, the rotation shaft 120*a* is disposed in a direction which is not parallel to the sheet surface of the sheet S abutting against the abutting portion 120*c* of the sensor flag 120 as in the first embodiment.

In the embodiment, an example has been described in which the rotation shaft 120*a* is provided in a direction perpendicular to the sheet surface, but the invention is not limited thereto. For example, as illustrated in FIGS. 9D and 9E, the rotation shaft 120*a* may be disposed at a predetermined inclination angle with respect to the sheet surface. The other configurations are the same as those of the first embodiment, and hence the same effect may be obtained.

[Third Embodiment]

Next, the configuration of an image reading apparatus including the sheet detecting apparatus according to the invention will be described with reference to FIG. 16. Furthermore, the same component as that of the above-described embodiments will be described by using the same reference numeral or the same name even when the reference numeral is different.

In the first and second embodiments, the printer illustrated in FIG. 1 is exemplified as an example of the image forming apparatus 18 including the sheet detecting apparatus 143. In the embodiment, FIG. 16 illustrates an example of an image reading apparatus 500 including a reading sensor 602 as an image reading portion that reads an original image recorded on an original 510 as the sheet. Then, the image reading apparatus 500 is equipped with an original detecting apparatus 603 including a sheet detector having the same configuration as the sheet detecting apparatus 143. The image reading apparatus 500 is applied to a scanner, a facsimile, a copying machine, and the like.

Figure 16:
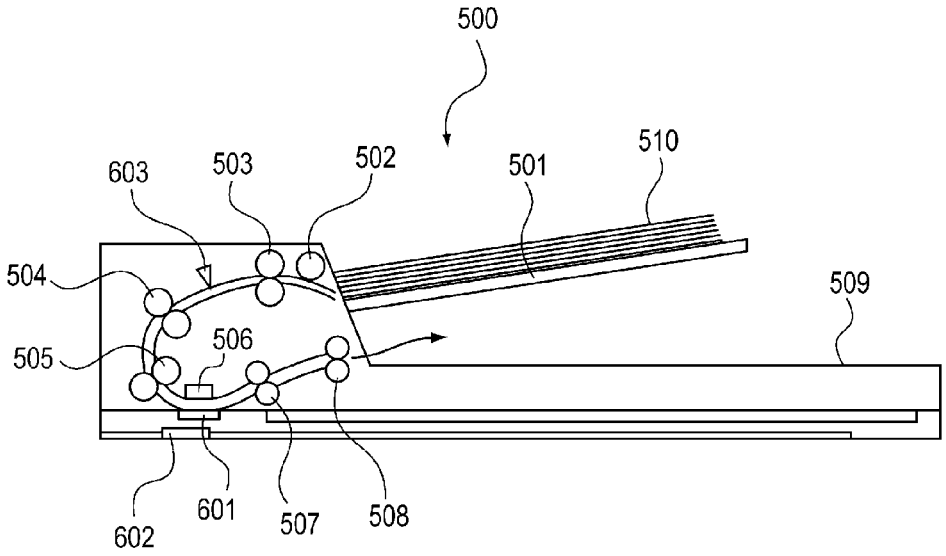
FIG. 16 is a cross-sectional view illustrating the configuration of an image reading apparatus including the sheet detecting apparatus according to the invention.

As illustrated in FIG. 16, the original 510 as the sheet stacked on an original tray 501 is fed by an original feeding roller 502, and is conveyed one by one while being separated by an original separating roller 503. The separated original 510 is conveyed to a reading position 601 by original conveying rollers 504 and 505. While the original 510 is guided by a platen guide 506 at the reading position 601, an original image is read therefrom by the reading sensor 602 as the image reading portion. Subsequently, the original is discharged to an original discharge portion 509 by an original conveying roller 507 and an original discharge roller 508.

The original conveying path illustrated in FIG. 16 is equipped with an original detecting apparatus 603 as a sheet detector having the same configuration as the sheet detecting apparatus 143. Then, the original 510 which is conveyed on the original conveying path is detected by the original detecting apparatus 603. The other configurations are the same as those of the above-described embodiments, and hence the same effect may be obtained.

Further, in the first and second embodiments, the sheet detecting apparatus 143 which is provided at the downstream side of the pair of fixing rollers 96 in the sheet conveying direction has been described. Then, in the third embodiment, the original detecting apparatus 603 which is provided at the upstream side of the reading position 601 in the original conveying direction has been described. In addition, the sheet (original) detecting apparatus may be used in various positions of the image forming apparatus 18 or the image reading apparatus 500.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-165763, filed Aug. 9, 2013, which is hereby incorporated by reference herein in its entirety.

What is claimed is:

1. A sheet detecting apparatus configured to detect a sheet conveyed by a sheet conveyor, comprising:

a sheet detector including a light emitting portion and a light receiving portion, configured to detect the sheet conveyed by the sheet conveyer; and a rod which is rotatable about a rotation axis, the rod including an abutting portion against which the sheet conveyed by the sheet conveyor abuts and a light shielding portion configured to shield an optical path of the sheet detector from the light emitting portion to the light receiving portion in accordance with the rotation of the rod, wherein the rod is rotated by an abutting of the sheet against the abutting portion of the rod, and the sheet detector detects the sheet in accordance with a shielding state of the optical path of the sheet detector, wherein an extension of the rotation axis of the rod crosses a conveying path of the sheet when viewed in a width direction of the sheet perpendicular to a conveyance direction of the sheet, and wherein the rotation axis of the rod is inclined so as to be closer to the conveying path of the sheet as the rotation axis of the rod extends in the conveyance direction of the sheet.

2. The sheet detecting apparatus according to claim 1, wherein the rod includes a rotation shaft configured to rotate about the rotating axis of the rod, and wherein the rotation shaft and the abutting portion are disposed at positions deviating from each other in the width direction of the sheet.

3. The sheet detecting apparatus according to claim 1, further comprising:

a sheet guide which guides the sheet conveyed by the sheet conveyor, the sheet guide having an opening, wherein the rod includes a rotation shaft configured to rotate about the rotation axis of the rod and an arm portion extending from the rotation shaft in a direction intersecting the rotation axis, wherein the abutting portion is provided at an end of the arm portion of the rod, and wherein the abutting portion is curved from the arm portion so as to be inserted into the opening of the sheet guide.

4. The sheet detecting apparatus according to claim 1, wherein an angle of the rotation axis with respect to a normal direction of a surface of the sheet against which the abutting portion abuts is in the range of 30° to 50°.

5. An image forming apparatus comprising:

the sheet detecting apparatus according to claim 1; and an image forming portion configured to form an image on a sheet.

6. The sheet detecting apparatus according to claim 1, wherein the rod includes a rotation shaft configured to rotate about the rotation axis of the rod and an arm portion extending from the rotation shaft in a direction intersecting the rotation axis of the rod, and wherein the abutting portion is provided at an end of the arm portion of the rod, and the light shielding portion is provided at an opposite side with respect to the arm portion of the rod across the rotation shaft.

7. The sheet detecting apparatus according to claim 1, further comprising a supporting portion which supports the rod such that the rod is located at a stand-by position.

8. The sheet detecting apparatus according to claim 7, wherein the supporting portion includes a cam surface.

9. The sheet detecting apparatus according to claim 1, wherein the rod includes a rotation shaft which is rotatable about the rotation axis of the rod, and wherein the abutting portion is provided outside the existing area of the rotation shaft in the width direction of the sheet.

10. The sheet detecting apparatus according to claim 1, wherein the sheet conveyor includes a conveying roller, and wherein the sheet detector is positioned outside the conveying roller in the width direction of the sheet.

11. The sheet detecting apparatus according to claim 10, wherein the conveying roller is a fixing roller.

12. A sheet detecting apparatus, comprising:

a sheet conveyer configured to convey a sheet;

a rod having an abutting portion on a longitudinal end portion thereof, configured to be rotatable about a rotation axis, the rod being rotated by an abutting of the sheet against the abutting portion of the rod; and a sheet detector configured to detect the sheet in accordance with a rotation of the rod, wherein an extension of the rotation axis of the rod crosses a conveying path of the sheet when viewed in a width direction of the sheet perpendicular to a conveyance direction of the sheet, and wherein the rotation axis of the rod is inclined so as to be closer to the conveying path of the sheet as the rotation axis of the rod extends in the conveyance direction of the sheet.

13. An image forming apparatus, comprising:

an image forming unit configured to form an image on the sheet;

a fixing unit having a pair of fixing rollers, configured to convey and heat the sheet on which the image has been formed, to fix the image on the sheet; and a sheet detecting unit configured to detect the sheet, the sheet detecting unit being provided downstream of the pair of fixing rollers in a conveyance direction of the sheet, the sheet detecting unit including:

a rod having an abutting portion on a longitudinal end portion thereof, configured to be rotatable about a rotation axis, the rod being rotated by an abutting of the sheet against the abutting portion of the rod, and a sheet detector configured to detect the sheet in accordance with a rotation of the rod, wherein an extension of the rotation axis of the rod crosses a conveying path of the sheet when viewed in a width direction of the sheet perpendicular to the conveyance direction of the sheet, and wherein the rotation axis of the rod is inclined so as to be closer to the conveying path of the sheet as the rotation axis of the rod extends in the conveyance direction of the sheet.

* * * * *